US008442836B2

(12) United States Patent
Li et al.

(10) Patent No.: US 8,442,836 B2
(45) Date of Patent: May 14, 2013

(54) METHOD AND DEVICE OF BITRATE DISTRIBUTION/TRUNCATION FOR SCALABLE AUDIO CODING

(75) Inventors: Te Li, Singapore (SG); Susanto Rahardja, Singapore (SG); Haibin Huang, Singapore (SG)

(73) Assignee: Agency for Science, Technology and Research, Singapore (SG)

( * ) Notice: Subject to any disclaimer, the term of this patent is extended or adjusted under 35 U.S.C. 154(b) by 414 days.

(21) Appl. No.: 12/865,691

(22) PCT Filed: Jan. 31, 2008

(86) PCT No.: PCT/SG2008/000036

§ 371 (c)(1),
(2), (4) Date: Oct. 19, 2010

(87) PCT Pub. No.: WO2009/096898

PCT Pub. Date: Aug. 6, 2009

(65) Prior Publication Data

US 2011/0046945 A1 Feb. 24, 2011

(51) Int. Cl.
*G10L 19/00* (2006.01)

(52) U.S. Cl.
USPC ..... 704/500; 704/200; 704/200.1

(58) Field of Classification Search ..... 704/200, 704/200.1, 500
See application file for complete search history.

(56) References Cited

U.S. PATENT DOCUMENTS

| | | | | |
|---|---|---|---|---|
| 5,636,324 | A * | 6/1997 | Teh et al. | 704/226 |
| 5,774,844 | A * | 6/1998 | Akagiri | 704/230 |
| 5,956,674 | A * | 9/1999 | Smyth et al. | 704/200.1 |
| 5,978,762 | A * | 11/1999 | Smyth et al. | 704/229 |
| 6,104,321 | A | 8/2000 | Akagiri | |
| 6,345,246 | B1 * | 2/2002 | Moriya et al. | 704/219 |
| 7,240,014 | B2 * | 7/2007 | Fuchigami et al. | 704/500 |
| 7,573,912 | B2 * | 8/2009 | Lindblom | 370/487 |
| 7,751,572 | B2 * | 7/2010 | Villemoes et al. | 381/23 |
| 2003/0220800 | A1 | 11/2003 | Budnikov | |
| 2004/0049379 | A1 | 3/2004 | Thumpudi et al. | |
| 2004/0105551 | A1 * | 6/2004 | Fuchigami et al. | 381/22 |
| 2004/0181395 | A1 | 9/2004 | Kim et al. | |
| 2005/0251709 | A1 * | 11/2005 | Kemmochi et al. | 714/699 |
| 2007/0016406 | A1 * | 1/2007 | Thumpudi et al. | 704/205 |
| 2008/0262850 | A1 * | 10/2008 | Taleb et al. | 704/500 |

FOREIGN PATENT DOCUMENTS

| | | | |
|---|---|---|---|
| EP | 1422694 | A2 | 5/2004 |
| GB | 2392359 | A | 2/2004 |
| WO | 2005098822 | A2 | 10/2005 |

OTHER PUBLICATIONS

Liu et al. "M/S Coding Based on Allocation Entropy", Proc. of the 6th Int. Conference on Digital Audio Effects (DAFX-03), London, UK, Sep. 8-11, 2003.*

Geiger et al. "ISO/IEC MPEG-4 High-Definition Scalable Advanced Audio Coding", J. Audio Eng. Soc., vol. 55, No. 1/2, 2007.*

(Continued)

*Primary Examiner* — Jialong He

(74) *Attorney, Agent, or Firm* — Hultquist, PLLC; Steven J. Hultquist

(57) ABSTRACT

Embodiments of the invention provides a method and device for assigning bitrates to a plurality of channels in a scalable audio encoding/truncation process. Different bitrates are assigned to different channels in the scalable audio encoding/truncation process.

13 Claims, 8 Drawing Sheets

OTHER PUBLICATIONS

Jean et al. "Two-stage bit allocation algorithm for stereo audio coder", IEE Proceedings of Vision, Image and Signal processing, Oct. 1996.*

Yang et al. "High-Fidelity Multichannel Audio Coding With Karhunen-Loève Transform", IEEE Transactions on Speech and Audio Processing, vol. 11, No. 4, Jul. 2003.*

Li, T., et al., "Efficient Stereo Bitrate Allocation for Fully Scalable Audio Codec", "10th Workshop on Multimedia Signal Processing, 2008 IEEE Piscataway, NJ, USA", Oct. 8, 2008, pp. 921-926.

Yu, R., et al., "MPEG-4 Scalable to Lossless Audio Coding", "117th Audio Engineering Society Convention Paper", Oct. 28-31, 2004, pp. 1-14, No. 6183.

* cited by examiner

METHOD AND DEVICE OF BITRATE DISTRIBUTION/TRUNCATION FOR SCALABLE AUDIO CODING

CROSS-REFERENCE TO RELATED APPLICATION

This application is a U.S. national phase under the provisions of 35 U.S.C. §371 of International Application No. PCT/SG08/00036 filed Jan. 31, 2008 in the names of Te Li, et al. for "METHOD AND DEVICE OF BITRATE DISTRIBUTION/TRUNCATION FOR SCALABLE AUDIO CODING." The disclosure of such international application is hereby incorporated herein by reference in its entirety, for all purposes.

FIELD OF INVENTION

Embodiments of the invention relate generally to scalable audio coding. Specifically, embodiments of the invention relate to bitrate distribution and/or bitrate truncation for scalable audio coding.

BACKGROUND

Due to the various scenario of applications, a scalable audio coding system is highly favorable, which is capable of producing a hierarchical bitstream whose bitrates can be dynamically changed during transmission.

For example, MPEG-4 scalable lossless (SLS) coding provides a gradual refinement, from perceptually weighted reconstruction levels provided by the perceptual audio coding (e.g., advanced audio coding, AAC) core bitstream up to the resolution of the original signal. The original signal is transformed by an integer modified discrete cosine transform (IntMDCT), and the resultant IntMDCT spectral data is coded with two complementary layers, including a core MPEG-4 AAC layer which generates an AAC compliant bit-stream at a pre-defined bitrate which constitutes the minimum rate/quality of the lossless bitstream, and a lossless enhanced layer that makes use of bit-plane coding method to produce fine grain scalable to lossless portion of the lossless bitstream.

In the MPEG-4 SLS encoder, the bitrate for different channels of the audio signal is equally distributed for lossy coding. For example, the bitrate assigned to each frame, $B_{r/f}$, is calculated as $$B_{r/f} = \frac{B_r \times N_{s/f}}{S}$$

wherein $B_r$ is the total bitrate (kbps), $N_{s/f}$ is the sample number/frame and S is the sampling rate. If there are two channels, $B_{r/f}$ is evenly distributed to the two channels as $$B_1 = B_2 = \frac{B_{r/f}}{2}.$$

For example, if the mid/side joint stereo coding (M/S stereo coding) is utilized, the bitrates assigned to the mid channel and the side channel are identical according to the equation above. The mid channel represents the Average of Left and Right channel data, and the side channel represents the Difference between Left and Right channel data. In another example, the first and the second channels are the left channel and the right channel, and the bitrate is then assigned to the left and right channel according to the above equation.

The lossless bitstream resulting from the SLS encoder can be directly decoded or can be truncated by a truncator. The lossless bitstream is truncated, e.g. for low bitrate applications, wherein the lossless bitstream may be truncated for each frame based on the target bitrate. For a frame, the original lossless bitstream lengths for the first and second channels are represented as $BS_1$ and $BS_2$, respectively. The target bitstream length is denoted as $BS^T$. In a standard SLS truncator, the truncated bitrates are allocated as $$BS_1^T = BS_2^T = \min\left\{\min(BS_1, BS_2), \frac{BS^T}{2}\right\}$$

M/S stereo coding can be used in lossy audio coding as well as lossless audio coding, for example, in MPEG-4 audio scalable lossless coding (SLS). In most cases, there is comparatively little difference between the audio data for the left and right channels; whereas in some other cases, there is much difference between the audio data for the left and right channels. Accordingly, encoding the data into mid and side channels usually results in a situation where the mid channel is much different from the side channel. In this case, evenly distributing bitrates between the mid channel and the side channel in the audio encoding, or evenly distributing truncated bitrates between the mid channel and the side channel, becomes inefficient.

SUMMARY OF THE INVENTION

Various embodiments of the invention provide an efficient method and device for bitrate assignment in the scalable audio encoding process.

An embodiment of the invention provides a method for assigning bitrates to a plurality of channels in a scalable audio encoding process. The method includes assigning different bitrates to different channels in the scalable audio encoding process.

Another embodiment of the invention provides a method for assigning truncated bitrates to a plurality of channels in a scalable audio truncation process. The method includes assigning different truncated bitrates to different channels in the scalable audio truncation process.

Other embodiments of the invention provide an encoder for scalable audio encoding, a computer readable medium for scalable audio encoding, a computer program element for scalable audio encoding, a scalable audio encoder, a truncator for scalable audio truncation, a computer readable medium for scalable audio truncation, and a computer program element for scalable audio truncation.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1:
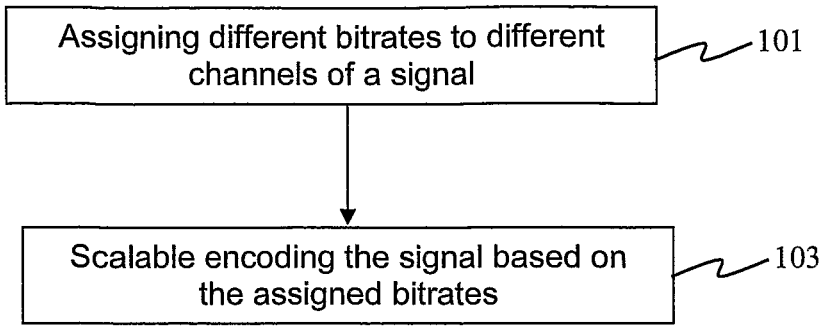
FIG. 1 shows a flowchart of assigning bitrates to a plurality of channels in a scalable audio encoding process according to an embodiment of the invention.

Various embodiments of the invention are based on the finding that the mid channel data amount is much different from the side channel data amount in most cases. Therefore, the smaller channel can be accurately encoded using fewer bitrates, thereby freeing up resources which can be employed more efficiently on the larger channel.

An embodiment of the invention provides a method for assigning bitrates to a plurality of channels in a scalable audio encoding process. The method may include assigning different bitrates to different channels in the scalable audio encoding process.

In one embodiment, the plurality of channels may include a mid channel and a side channel of a mid/side stereo encoding process. A first bitrate is assigned to the mid channel, and a second bitrate, which is different from the first bitrate, is assigned to the side channel. In another embodiment, the plurality of channels may include a left channel and a right channel.

According to an embodiment of the invention, the different bitrates are determined based on psychoacoustic information. For example, the different bitrates may be determined based on the ratio of psychoacoutic information in the different channels.

The different bitrates may be assigned to different channels of each audio frame in a bit-plane encoding process. In one embodiment, the different bitrates are assigned to different channels based on bit-plane values for different channels. In another embodiment, the different bitrates are assigned to different channels based on the ratio of bit-plane values for different channels.

In a further embodiment, the different bitrates are assigned to different channels based on the ratio of maximum bit-plane values for the different channels. In another embodiment, the different bitrates are assigned to different channels based on the ratio of average maximum bit-plane values for all the scalefactor bands (sfb) for different channel. For example, the different bitrates may be assigned to different channels based on the ratio of a first average maximum bit-plane value and a second average maximum bit-plane value. The first average maximum bit-plane value may include an average value of a plurality of maximum bit-plane values for a first channel of the plurality of channels, and the second average maximum bit-plane value comprises an average value of a plurality of maximum bit-plane values for a second channel of the plurality of channels.

Based on the different bitrates assigned to different channels, the audio signal is scalable encoded, e.g. to form a scalable lossless bitstream. The scalable lossless bitstream may be used in different applications, which may have different available/target bitrates. The scalable lossless bitstream may be truncated to cater for different applications according to the embodiment of the invention.

According to one embodiment, it is further determined as to whether a target total bitrate is smaller than or equal to the sum of a first perceptual core bitrate for a first channel of the plurality of channels and a second perceptual core bitrate for a second channel of the plurality of channels.

If the target total bitrate is smaller than or equal to the sum of a first perceptual core bitrate for a first channel of the plurality of channels and a second perceptual core bitrate for a second channel of the plurality of channels, different truncated bitrates may be assigned to different channels in a scalable audio truncation process based on the total bitrate, the first perceptual core bitrate, and the second perceptual core bitrate, in one embodiment. In another embodiment, if the target total bitrate is smaller than or equal to the sum of the first perceptual core bitrate and the second perceptual core bitrate, the different truncated bitrates may be assigned to different channels in the scalable audio truncation process based on the total bitrate, and a ratio between the first perceptual core bitrate and the second perceptual core bitrate.

In a further embodiment, if the target total bitrate is smaller than or equal to the sum of the first perceptual core bitrate and the second perceptual core bitrate, a first truncated bitrate may be assigned to the first channel of the plurality of channels in accordance with the following equation:

$$BS_1^T = BS^T \cdot \frac{BS_1^P}{BS_1^P + BS_2^P};$$

and a second truncated bitrate is assigned to a second channel of the plurality of channels in accordance with the following equation:

$$BS_2^T = BS^T \cdot \frac{BS_2^P}{BS_1^P + BS_2^P}.$$

Wherein $BS^T$ denotes the first truncated bitrate assigned to the first channel of the plurality of channels;

$BS^T$ denotes the target total bitrate;

$BS_1{}^P$ denotes the first perceptual core bitrate for the first channel of the plurality of channels;

$BS_2{}^P$ denotes the second perceptual core bitrate for the second channel of the plurality of channels;

$BS_2{}^T$ denotes the second truncated bitrate assigned to the second channel of the plurality of channels.

It is to be understood that the above equations for the first channel and the second channel may be modified accordingly if the plurality of channels include more than two channels.

According to another embodiment, if it is determined that the target total bitrate is greater than the sum of the first perceptual core bitrate for the first channel of the plurality of channels and the second perceptual core bitrate for the second channel of the plurality of channels, different truncated bitrates may be assigned to different channels in the scalable audio truncation process based on the first perceptual core bitrate, the second perceptual core bitrate, a first enhancement bitrate for an enhancement layer of the first channel, and a second enhancement bitrate for an enhancement layer of the second channel. In another embodiment, if the target total bitrate is greater than the sum of the first perceptual core bitrate and the second perceptual core bitrate, the different truncated bitrates may be assigned to different channels in the scalable audio truncation process based on the first perceptual core bitrate, the second perceptual core bitrate, and a ratio between the first enhancement bitrate assigned to the enhancement layer of the first channel and the second enhancement bitrate assigned to the enhancement layer of the second channel.

In a further embodiment, if the target total bitrate is greater than the sum of the first perceptual core bitrate and the second perceptual core bitrate, a first truncated bitrate may be assigned to the first channel in accordance with the following equation:

$$BS_1^T = BS_1^P + (BS^T - BS_1^P - BS_2^P) \cdot \frac{BS_1 - BS_1^P}{BS_1 - BS_1^P + BS_2 - BS_2^P};$$

a second truncated bitrate may be assigned to the second channel in accordance with the following equation:

$$BS_2^T = BS_2^P + (BS^T - BS_1^P - BS_2^P) \cdot \frac{BS_2 - BS_2^P}{BS_1 - BS_1^P + BS_2 - BS_2^P};$$

wherein $BS_1^T$ denotes the first truncated bitrate assigned to the first channel of the plurality of channels;

$BS^T$ denotes the target total bitrate;

$BS_1^P$ denotes the first perceptual core bitrate for the first channel of the plurality of channels;

$BS_2^P$ denotes the second perceptual core bitrate for the second channel of the plurality of channels;

$BS_1$ denotes a first partial bitrate provided for the first channel of the plurality of channels;

$BS_2$ denotes a second partial bitrate provided for the second channel of the plurality of channels;

$BS_2^T$ denotes the second truncated bitrate assigned to the second channel of the plurality of channels.

It is to be understood that the above equations for the first channel and the second channel may be modified accordingly if the plurality of channels include more than two channels.

Another embodiment of the invention provides a method for assigning truncated bitrates to a plurality of channels of a bitstream in a scalable audio truncation process. The method includes assigning different truncated bitrates to different channels in the scalable audio truncation process.

In one embodiment, the plurality of channels includes a mid channel and a side channel of a mid/side stereo decoding process. A first truncated bitrate may be assigned to the mid channel, and a second truncated bitrate, which is different from the first truncated bitrate, may be assigned to the side channel. In another embodiment, the plurality of channels may include a left channel and a right channel. The bitstream may be a scalable lossless bitstream derived by scalable encoding an audio signal, for example. The bitstream may also be a lossy bitstream derived by lossy encoding an audio signal, in another example.

According to one embodiment, it is determined as to whether a target total bitrate is smaller than or equal to the sum of a first perceptual core bitrate for a first channel of the plurality of channels and a second perceptual core bitrate for a second channel of the plurality of channels.

If the target total bitrate is smaller than or equal to the sum of a first perceptual core bitrate for a first channel of the plurality of channels and a second perceptual core bitrate for a second channel of the plurality of channels, different truncated bitrates may be assigned to different channels in the scalable audio truncation process based on the total bitrate, the first perceptual core bitrate, and the second perceptual core bitrate, in one embodiment. In another embodiment, if the target total bitrate is smaller than or equal to the sum of the first perceptual core bitrate and the second perceptual core bitrate, the different truncated bitrates may be assigned to different channels in the scalable audio truncation process based on the total bitrate, and a ratio between the first perceptual core bitrate and the second perceptual core bitrate.

In a further embodiment, if the target total bitrate is smaller than or equal to the sum of the first perceptual core bitrate and the second perceptual core bitrate, a first truncated bitrate may be assigned to the first channel of the plurality of channels in accordance with the following equation:

$$BS_1^T = BS^T \cdot \frac{BS_1^P}{BS_1^P + BS_2^P};$$

and a second truncated bitrate is assigned to a second channel of the plurality of channels in accordance with the following equation:

$$BS_2^T = BS^T \cdot \frac{BS_2^P}{BS_1^P + BS_2^P}.$$

Wherein $BS_1^T$ denotes the first truncated bitrate assigned to the first channel of the plurality of channels;

$BS^T$ denotes the target total bitrate;

$BS_1^P$ denotes the first perceptual core bitrate for the first channel of the plurality of channels;

$BS_2^P$ denotes the second perceptual core bitrate for the second channel of the plurality of channels;

$BS_2^T$ denotes the second truncated bitrate assigned to the second channel of the plurality of channels.

It is to be understood that the above equations for the first channel and the second channel may be modified accordingly if the plurality of channels include more than two channels.

According to another embodiment, if it is determined that the target total bitrate is greater than the sum of the first perceptual core bitrate for the first channel of the plurality of channels and the second perceptual core bitrate for the second channel of the plurality of channels, different truncated bitrates may be assigned to different channels in the scalable audio truncation process based on the first perceptual core bitrate, the second perceptual core bitrate, a first enhancement bitrate for an enhancement layer of the first channel, and a second enhancement bitrate for an enhancement layer of the second channel. In another embodiment, if the target total bitrate is greater than the sum of the first perceptual core bitrate and the second perceptual core bitrate, the different truncated bitrates may be assigned to different channels in the scalable audio truncation process based on the first perceptual core bitrate, the second perceptual core bitrate, and a ratio between the first enhancement bitrate assigned to the enhancement layer of the first channel and the second enhancement bitrate assigned to the enhancement layer of the second channel.

In a further embodiment, if the target total bitrate is greater than the sum of the first perceptual core bitrate and the second perceptual core bitrate, a first truncated bitrate may be assigned to the first channel in accordance with the following equation:

$$BS_1^T = BS_1^P + (BS^T - BS_1^P - BS_2^P) \cdot \frac{BS_1 - BS_1^P}{BS_1 - BS_1^P + BS_2 - BS_2^P};$$

a second truncated bitrate may be assigned to the second channel in accordance with the following equation:

$$BS_2^T = BS_2^P + (BS^T - BS_1^P - BS_2^P) \cdot \frac{BS_2 - BS_2^P}{BS_1 - BS_1^P + BS_2 - BS_2^P};$$

wherein $BS_1^T$ denotes the first truncated bitrate assigned to the first channel of the plurality of channels;

$BS^T$ denotes the target total bitrate;

$BS_1^P$ denotes the first perceptual core bitrate for the first channel of the plurality of channels;

$BS_2^P$ denotes the second perceptual core bitrate for the second channel of the plurality of channels;

$BS_1$ denotes a first partial bitrate provided for the first channel of the plurality of channels;

$BS_2$ denotes a second partial bitrate provided for the second channel of the plurality of channels;

$BS_2^T$ denotes the second truncated bitrate assigned to the second channel of the plurality of channels.

It is to be understood that the above equations for the first channel and the second channel may be modified accordingly if the plurality of channels include more than two channels.

According to an embodiment of the invention, the bitstream may be truncated based on the assigned truncated bitrates, such that a prioritized truncation is performed on different channels.

Another embodiment of the invention relates to a method of decoding a bitstream in a scalable audio decoding process. In one embodiment, a bitrate assignment information may be received from another device, e.g. a scalable audio encoder. The bitrate assignment information may be embedded in an encoded bitstream in another embodiment. The bitrate assignment information indicates the different bitrates assigned to the different channels of the bitstream in the scalable audio encoding process. Based on the received bitrate assignment information, the bitstream is decoded in the scalable audio decoding process.

In another embodiment, the bitrate assignment information indicates the different truncated bitrates for different channels used to truncate the encoded bitstream. Based on the bitrate assignment information, the encoded bitstream which is further truncated in a scalable audio truncation process may be decoded in the scalable audio decoding process.

Other embodiments of the invention provide an encoder for scalable audio encoding, a computer readable medium for scalable audio encoding, a computer program element for scalable audio encoding, a scalable audio encoder, a truncator for scalable audio truncation, a computer readable medium for scalable audio truncation, a computer program element for scalable audio truncation, which will be described in more detail in the examples below.

FIG. 1 shows a flowchart of assigning bitrates to a plurality of channels in a scalable audio encoding process according to an embodiment of the invention.

At 101, different bitrates are assigned to different channels of a signal. For example, different bitrates may be assigned to mid and side channels of an audio signal. At 103, the signal is scalable encoded based on the different bitrates assigned to different channels. In one example, the mid channel may be assigned more bitrates such that the mid channel data is encoded with more accuracy.

Figure 2:
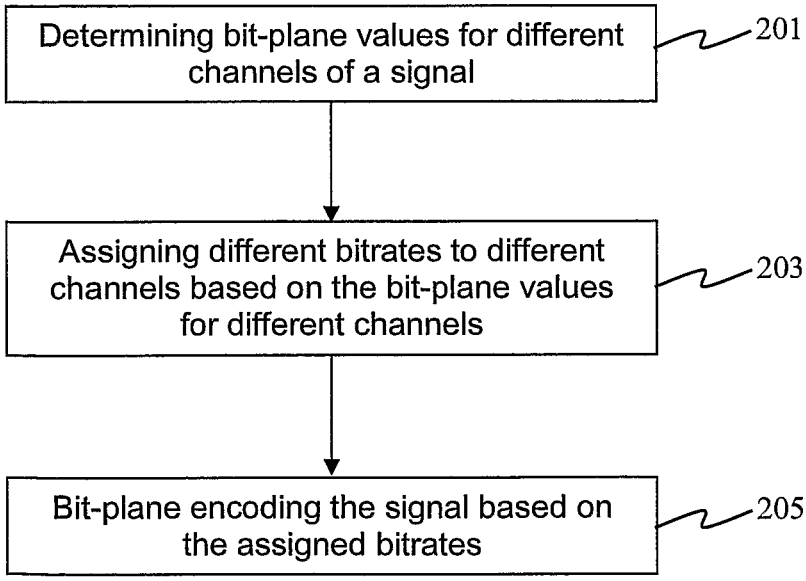
FIG. 2 shows a flowchart of assigning bitrates to a plurality of channels in a scalable audio encoding process according to another embodiment of the invention.

FIG. 2 shows a flowchart of assigning bitrates to a plurality of channels in a scalable audio encoding process according to another embodiment of the invention.

At 201, bit-plane values for different channels of a signal, e.g. for different channels of each frame of an audio signal, is determined. Different bitrates are assigned to different channels based on the bit-plane values for different channels at 203. For example, different bitrates may be assigned to mid and side channels of an audio signal. The bitrates may be assigned based on the ratio of bit-plane values for the different channels in one embodiment, and may be assigned based on the ratio of maximum bit-plane values for the different channels in another embodiment. In a further embodiment, the different bitrates may be assigned based on the ratio of average maximum bit-plane values assigned to the different channels. The signal is bit-plane encoded based on the different bitrates assigned to different channels at 205. For example, the mid channel may be assigned with more bitrates such that the mid channel data is encoded with higher accuracy.

Figure 3A:
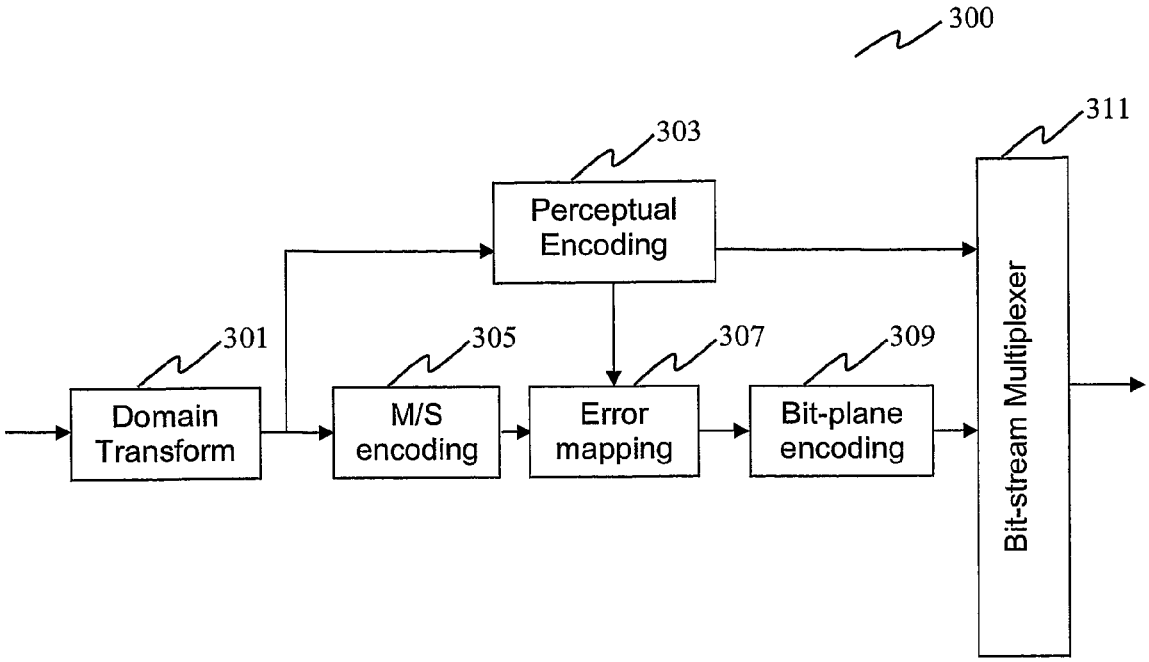
FIGS. 3A and 3B show the structure of a scalable lossless audio encoder 300, 350 according to the embodiments of the invention.
Figure 3B:
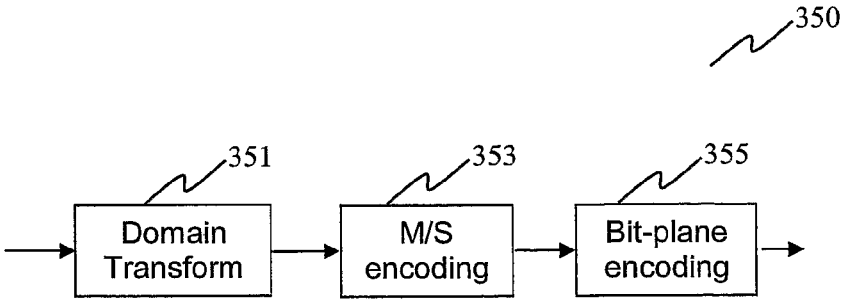

FIGS. 3A and 3B show the structure of a scalable lossless audio encoder 300, 350 according to various embodiments of the invention.

It is to be noticed that a circuit as described in this description may be hard wired logic, a controller, a microcontroller, or a microprocessor (including e.g. a complex instruction set computer (CISC) processor or a reduced instruction set computer (RISC) processor).

In FIG. 3A, the scalable lossless (SLS) audio encoder 300 includes a domain transform circuit 301 configured to transform an audio signal to form a transformed signal. The domain transform circuit 301 may be an integer modified discrete Cosine transform (IntMDCT), for example. The encoder 300 includes an encoding circuit 303 configured to encode the transformed signal to form a core-layer bitstream. For example, the encoding circuit 303 may be a perceptual (lossy) encoding circuit or a core-layer encoding circuit, which may generate the core-layer bitstream constituting the minimum rate/quality unit of a lossless stream. In one example, the encoding circuit 303 is a MPEG-4 AAC (advanced audio coding) encoder.

The SLS encoder 300 further includes a mid/side encoding circuit 305 configured to encode the transformed signal to form a mid/side encoded signal. For example, if the transformed signal has left and right channels, the mid/side encoded signal is encoded to have mid and side channels.

An error mapping circuit 307 is included to perform an error mapping process based on the mid-side encoded signal and the core-layer bitstream. The information which has been encoded into the encoding circuit 303 is then removed from the transformed signal, resulting in an error signal.

The SLS encoder also includes a bit-plane encoding circuit 309 configured to bit-plane encode the error signal based on different bitrates to form an enhancement-layer bitstream. The bit-plane encoding circuit 309 may include an assignment circuit configured to assign the different bitrates to different channels of a plurality of channels in the bit-plane coding process. For example, the different bitrates may be assigned based on the bit-plane values for different channels, as explained in the embodiments above.

A bitstream multiplexing circuit 311 is configured to multiplex the core-layer bitstream and the enhancement-layer bitstream, thereby generating the scalable encoded bitstream, which is a lossless bitstream.

It is noticed that the above encoding circuit 303 of the SLS encoder 300 is used to generate the core-layer bitstream from the transformed audio signal in accordance with the embodiment of the invention.

FIG. 3B shows a non-core scalable lossless audio encoder 350 according to another embodiment of the invention.

The SLS encoder 350 includes a domain transform circuit 351 configured to transform an audio signal to form a transformed signal. The domain transform circuit 351 may be an integer modified discrete Cosine transform (IntMDCT), for example.

The SLS encoder 350 further includes a mid/side encoding circuit 353 configured to encode the transformed signal to form a mid/side encoded signal. For example, if the transformed signal has left and right channels, the left and right channel information is encoded to become mid and side channel information.

A bit-plane encoding circuit 355 is included to bit-plane encode the mid/side encoded signal based on different bitrates for different channels. The bit-plane encoding circuit 355 may include an assignment circuit configured to assign the different bitrates to different channels of a plurality of channels in the bit-plane coding process. For example, the different bitrates may be assigned based on the bit-plane values assigned to different channels, as explained in the embodiments above. After the mid/side encoded signal is encoded through the bit-plane encoding circuit 355, a lossless bitstream is formed.

The non-core SLS encoder 350 may be used such that perceptual information of the audio signal is not used to determine the different bitrates for different channels in the bit-plane coding process.

The non-core SLS encoder 350 may also have a structure of the SLS encoder 300 of FIG. 3A, wherein the encoding circuit 303 is disabled.

The assignment of different bitrates to different channels in the method of FIGS. 1 and 2 and in the SLS audio encoder of FIG. 3 is explained in more detail with reference to FIG. 4.

Figure 4:
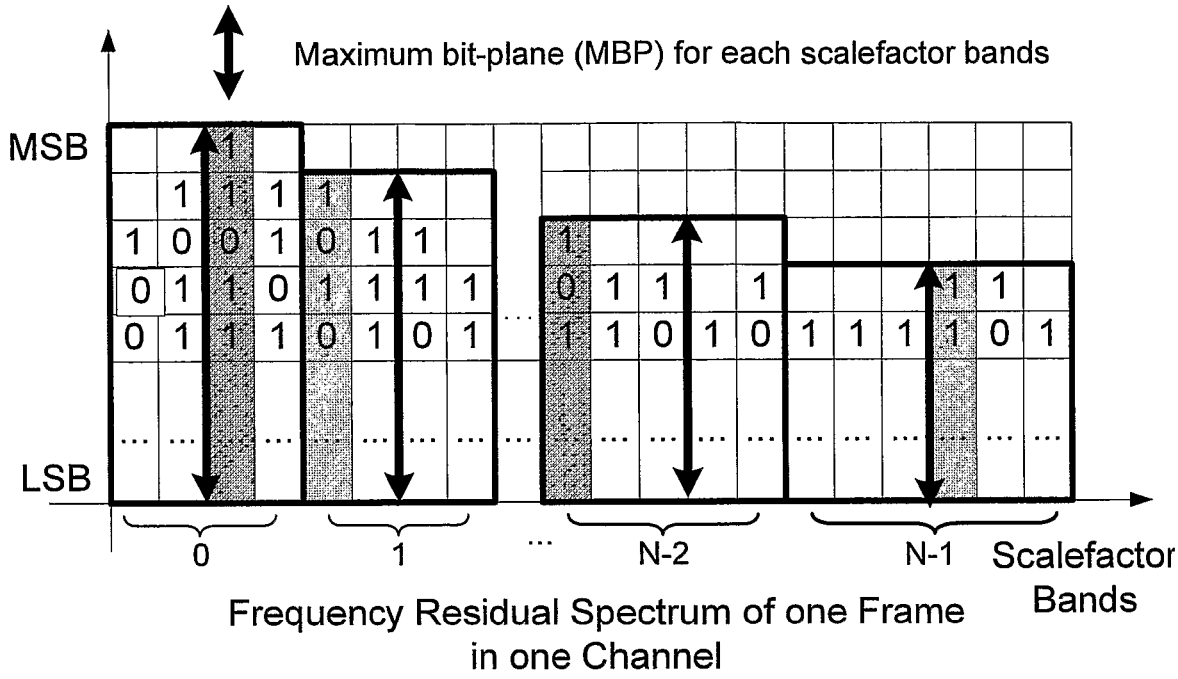
FIG. 4 shows the maximum bit-plane level values of each scale-factor bands (sfb) for a frame in one channel.

FIG. 4 shows the maximum bit-plane values of each scalefactor bands (sfb) for one frame in one channel. For each scale-factor band (sfb), the maximum bit-plane level is the bit-plane level of the maximum amplitude spectrum coefficient.

For an input of n-dimensional data vector $x=\{x_0, x_1, \ldots, x_{n-1}\}$, each element $x_i$, $i=n-1$ can be represented in a binary format $$x_i = (2s_i - 1)\cdot \sum_{j=-\infty}^{\infty} b_{i,j}\cdot 2^j$$

that includes a sign symbol $$s_i = \begin{cases} 1 & x_i \geq 0 \\ 0 & x_i < 0 \end{cases}$$

and the bit-plane symbols $b_{ij}\in\{0, 1\}$. The bit-plane symbols usually starts from a maximum bit-plane $M_i$ that satisfies $$2^{M_i-1} \leq \max\{|x_i|\} < 2^{M_i}$$

In bit-plane coding, the input data vector is first scanned into sign and bit-plane symbols, usually from MSB to LSB. The resultant binary string is then entropy coded with a properly assigned statistical model. In the decoder, the data flow is reversed where the sign and amplitude symbols are decoded to reconstruct the original data vectors. The compressed bitstream resultant from the bit-plane coding can be arbitrarily truncated to lower rates which still can be decoded to a coarse reconstruction that comprises partial bit-plane symbols. Thus, bit-plane coding provides a convenient way to implement an embedded code with sequentially refined step size.

In one embodiment, the bitrates for different channels used in the bit-plane coding process may be assigned/distributed based on the average values of the maximum bit-planes (MBP) for each channel. The average MBP value for each channel is calculated based on the MBP for each scalefactor bands as shown in FIG. 4. For each frame, the average MBP values are calculated as follows $$M_{Average,1} = \frac{\sum_{i=0}^{N-1} M_{1,i}}{N},$$

$$M_{Average,2} = \frac{\sum_{i=0}^{N-1} M_{2,i}}{N}$$

wherein $M_{Average,1}$ and $M_{Average,2}$ are the average MBP values for the first and the second channel of the frame, respectively. N is the number of total scalefactor bands (sfbs) in the frame. $M_{1,i}$ and $M_{2,i}$ denote the MBP of the bit-planes for the sfb i in the first channel and the second channel, respectively. Then, the ratio of the average values in the first and the second channel, r is computed as $$r = \frac{M_{Average,1}}{M_{Average,2}}$$

and the bitrate assigned for each channel is then assigned according to the following equations $$B_1 = \frac{B_{r/f}\times r}{r+1},$$

$$B_2 = \frac{B_{r/f}}{r+1}$$

wherein $B_{r/f}$ is the total bitrate for each frame.

From the above equations, it is noticed that more bitrates are assigned to the channel with higher average maximum bit-plane values.

In another embodiment, the bitrates for different channels used in the bit-plane coding process may be assigned/distributed based on the average maximum bit-plane values for each channel, wherein the average maximum bit-plane values for each channel is determined in consideration of the number of spectrum coefficients in each scale factor band.

For each frame, the average MBP values are calculated as follows $$\hat{M}_{Average,1} = \frac{\sum_{i=0}^{N-1} M_{1,i} * W_i}{N},$$

$$\hat{M}_{Average,2} = \frac{\sum_{i=0}^{N-1} M_{2,i} * W_i}{N}$$

wherein $\hat{M}_{Average,1}$ and $\hat{M}_{Average,2}$ are the average total MBP values for the first and the second channel of the frame, respectively. N is the number of total scalefactor bands (sfbs) in the frame, with $W_i$ denotes the number of spectrum coefficients for the sib i. $M_{1,i}$ and $M_{2,i}$ denote the MBP of the bit-planes for the sfb i in the first channel and the second channel, respectively Then, the ratio of the average values in the first and the second channel, r is computed as $$r = \frac{\hat{M}_{Average,1}}{\hat{M}_{Average,2}}$$

and the bitrate assigned for each channel is then assigned according to the following equations $$B_1 = \frac{B_{r/f} \times r}{r+1},$$

$$B_2 = \frac{B_{r/f}}{r+1}$$

wherein $B_{r/f}$ is the total bitrate for each frame.

From the above equations, it is noticed that more bitrates are assigned to the channel with higher average maximum bit-plane values.

Figure 5:
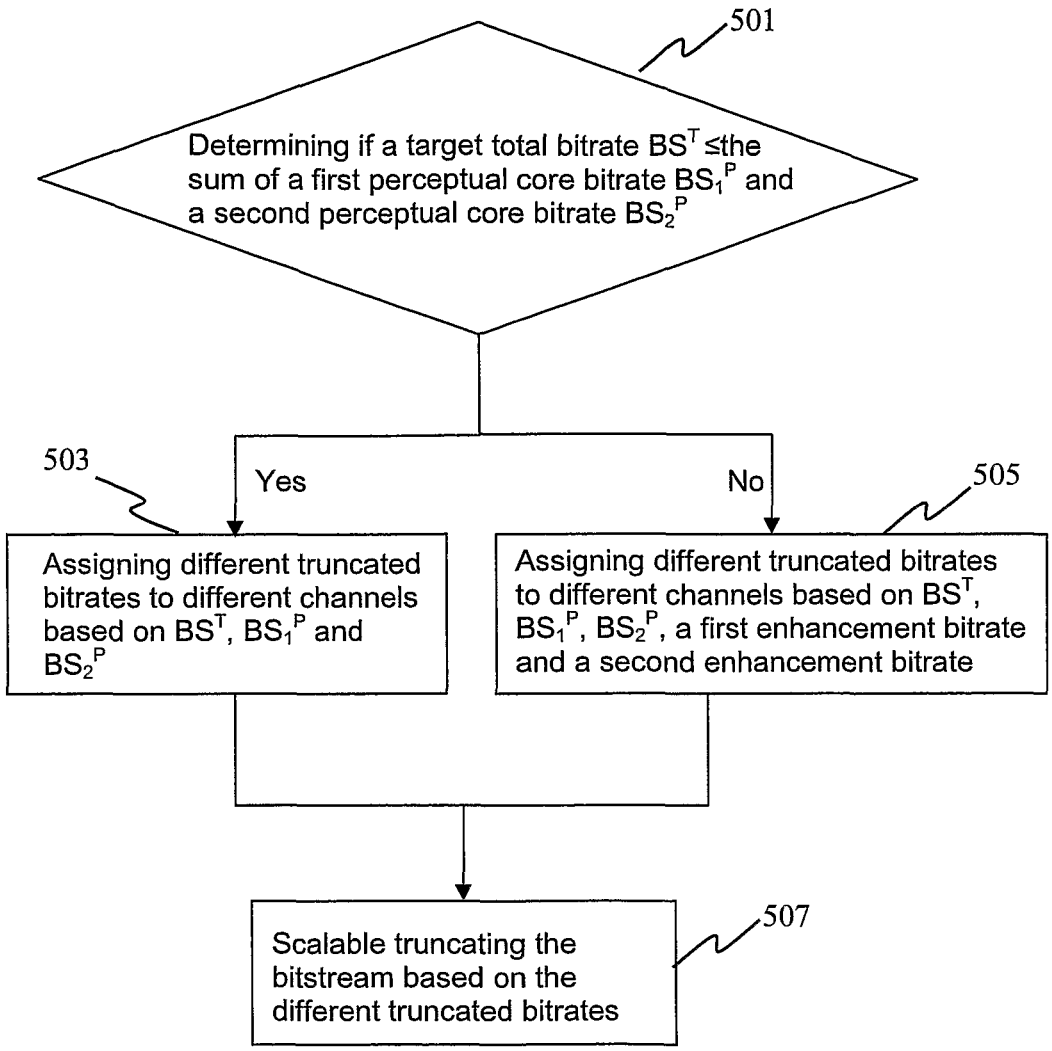
FIG. 5 shows a flowchart of assigning different truncated bitrates to different channels according to an embodiment of the invention.

FIG. 5 shows a flowchart of assigning different truncated bitrates to different channels in a scalable truncation process according to an embodiment of the invention.

At 501, it is determined whether a target total bitrate $BS^T$ is smaller than or equal to the sum of a first perceptual core bitrate $BS_1^P$ for a first channel and a second perceptual core bitrate $BS_2^P$ for a second channel of a plurality of channels.

If yes, different truncated bitrates are assigned to different channels at 503 based on the target total bitrate $BS^T$, the first perceptual core bitrate $BS_1^P$ and the second perceptual core bitrate $BS_2^P$. In one example, the target total bitrate $BS^T$ may be divided into two different truncated bitrates based on the ratio between the first perceptual core bitrate and the second perceptual core bitrate.

If it is determined at 501 that the target total bitrate is greater than the sum of the first perceptual core bitrate $BS_1^P$ for the first channel and the second perceptual core bitrate $BS_2^P$ for the second channel, different truncated bitrates may be assigned to different channels at 505 based on the target total bitate $BS^T$, the first perceptual core bitrate $BS_1^P$, the second perceptual core bitrate $BS_2^P$, a first enhancement bitrate for an enhancement layer of the first channel, and a second enhancement bitrate for an enhancement layer of the second channel. In one example, the target total bitrate $BS^T$ may be divided into two different truncated bitrates based on the ratio between the first enhancement bitrate and the second enhancement bitrate.

After the different truncated bitrate is determined for different channels at 503 or 505, a bitstream may be scalable truncated based on the different truncated bitrates. In one example, an input audio signal has been encoded into a lossless bitstream by the SLS encoder 300, 350 described above. The resultant lossless bitstream is then truncated/compressed using the different truncated bitrates as assigned in 503 or 505 above, so that a truncated bitstream may be formed for situations with only limited target total bitrate.

Figure 6A:
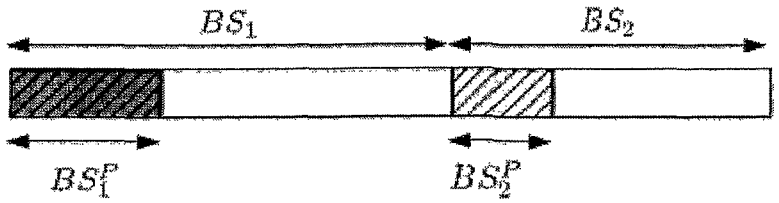
FIGS. 6A-6C show different truncated bitrates assigned for different channels according to the embodiments of the invention.
Figure 6B:
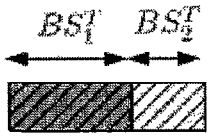
Figure 6C:
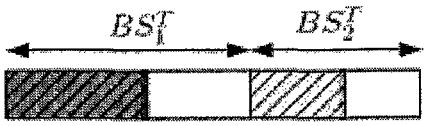

The embodiments of assigning different truncated bitrates for different channels are described in FIGS. 6A-6C in more detail.

FIG. 6A shows a lossless bitstream, wherein $BS_1$ and $BS_2$ represent the bitstream for the first channel and the second channel, respectively. $BS_1^P$ and $BS_2^P$ denote the perceptual core for the first and the second channels in the lossless bitstream. The bitstreams $BS_1$-$BS_1^P$ and $BS_2$-$BS_2^P$ represent the enhancement bitstream for the first channel and the second channel, respectively.

hi one embodiment, a target total bitrate $BS^T$ is smaller than or equal to the sum of the first perceptual core bitrate BSP and the second perceptual core bitrate $BS_2^P$, i.e., $BS^T \leqq BS_1^P + BS_2^P$. In order to optimize the basic perceptual quality, the truncated bitrates are allocated as shown in FIG. 6B according to the following equations:

$$BS_1^T = BS^T \cdot \frac{BS_1^P}{BS_1^P + BS_2^P},$$

$$BS_2^T = BS^T \cdot \frac{BS_2^P}{BS_1^P + BS_2^P}$$

As seen from the resultant bitstream in FIG. 6B, the enhancement bitstreams for the first channel and the second channel have been removed, and the first perceptual core bitstream and the second perceptual core bitstream have been truncated based on the ratio between the first perceptual core bitstream and the second perceptual core bitstream.

In another embodiment, the target total bitrate $BS^T$ is greater than the sum of the first perceptual core bitrate $BS_1^P$ and the second perceptual core bitrate $BS_2^P$, i.e., $BS^T > BS_1^P + BS_2^P$. In this case, the perceptual core bitstream may be remained, and the enhancement bitstream may be truncated. The resultant truncated bitstream for each channel as shown in FIG. 6C is determined according to the following equations:

$$BS_1^T = BS_1^P + (BS^T - BS_1^P - BS_2^P) \cdot \frac{BS_1 - BS_1^P}{BS_1 - BS_1^P + BS_2 - BS_2^P},$$

$$BS_2^T = BS_2^P + (BS^T - BS_1^P - BS_2^P) \cdot \frac{BS_2 - BS_2^P}{BS_1 - BS_1^P + BS_2 - BS_2^P}$$

As seen from FIG. 6B, the first perceptual core bitstream and the second perceptual core bitstream have been retained, and the enhancement bitstreams for the first channel and the second channel have been truncated based on the ratio between the first enhancement bitstream and the second enhancement bitstream.

It is to be noticed that the lossless bitstream may be a non-core bitstream without the first perceptual core bitstream and the second perceptual core bitstream. The different truncated bitrate may be assigned based on the ratio between the first bitstream for the first channel and the second bitstream for the second channel.

In other embodiments, the truncated bitrates for different channels may be assigned such that the bitrate for one of some of the plurality of channels is truncated more. For example, more truncated bitrate may be assigned to the mid channel compared to that of the side channel such that the side channel bitstream is more truncated than the mid channel bitstream. This illustratively means, the bitrates is truncated with priorities on the mid channel.

Figure 7:
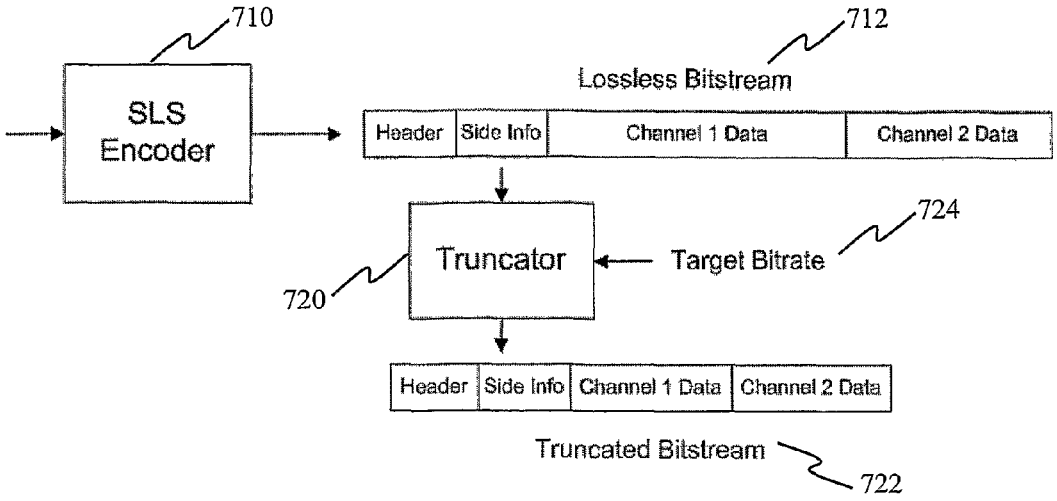
FIG. 7 shows the structure of a SLS encoder and a truncator according to an embodiment of the invention.

FIG. 7 shows the structure of a SLS encoder and a truncator according to an embodiment of the invention.

The audio signal is encoded through the SLS encoder 710, resulting in a lossless bitstream 712. The lossless bitstream 712 includes header information, side information, and the data for each channel of the plurality of channels. In this example, the SLS encoder 710 may be the SLS encoder 300, 350 of FIGS. 3A and 3B.

A truncator 720 is included to assign different truncated bitrates to different channels, such that the lossless bitstream 712 is truncated to form the truncated bitstream 722 based on the assigned different truncated bitrate. A target bitrate 724 is used by the truncator to determine the different truncated bitrates for different channels. And the different truncated bitrates may be assigned according to the embodiments described with reference to FIGS. 5 and 6 above.

According to the above embodiments of the invention for the assignment of different bitrates and/or different truncated bitrates for different channels, no additional side information and complexity is involved as the bitrate per channel is encoded in the bitstream in the original codec.

Figure 8:
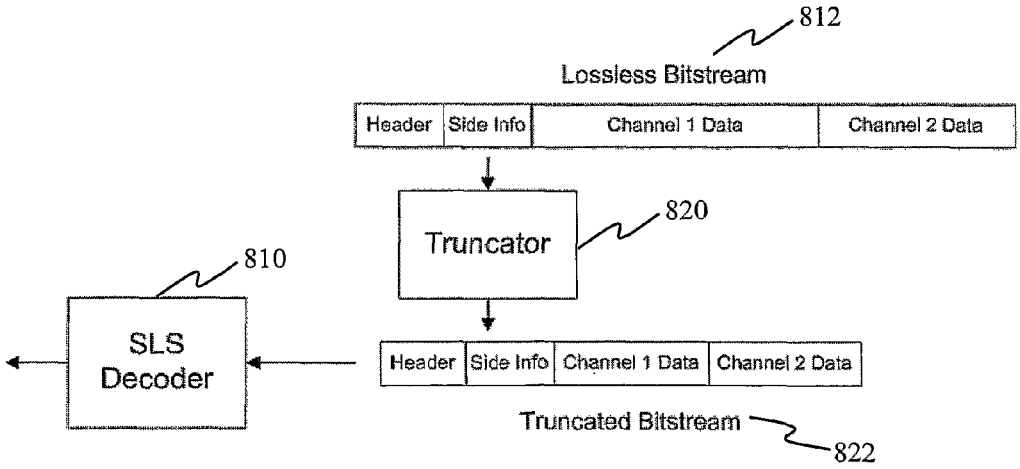
FIG. 8 shows an SLS decoder and a truncator according to an embodiment of the invention.

FIG. 8 shows a SLS decoder for decoding a truncated bitstream from a truncator according to an embodiment of the invention.

A lossless bitstream 812 may be truncated by a truncator 820 to form a truncated bitstream 822, similar to FIG. 7 described above. The lossless bitstream 812 is truncated based on different truncated bitrates assigned to different channels by the truncator 820. As seen from the truncated bitstream 822, the data for each channel has been truncated.

An SLS decoder 810 decodes the truncated bitstream 822 to form a reconstructed audio signal. The reconstructed audio signal may be a lossy signal as the truncated bitstream 822 is a lossy bitstream.

The method of scalable decoding a bitstream and the corresponding SLS decoder according to the embodiments of the invention are described in the following.

Figure 9:
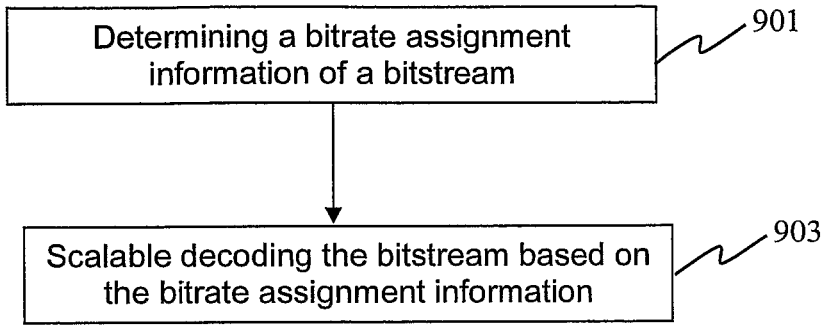
FIG. 9 shows a flowchart of a scalable audio decoding process according to an embodiment of the invention.

FIG. 9 shows a flowchart of decoding a bitstream in a scalable audio decoding process according to an embodiment of the invention.

At 901, a bitrate assignment information of a bitstream is determined. The bitrate assignment information may be received from another device, e.g. a scalable audio encoder, or may be be embedded in the bitstream.

In one embodiment, the bitstream may be a lossless bitstream encoded by the scalable lossless encoder 300, 350 of FIGS. 3A and 3B, for example. The bitrate assignment information may indicate different bitrates assigned to the different channels of the bitstream in the scalable audio encoding process as described in the various embodiments above.

In another embodiment, the bitstream may be a truncated bitstream derived from a truncator 720, 802 of FIGS. 7 and 8, for example. The bitrate assignment information may indicate different truncated bitrates for different channels used to truncate the bitstream as described in the embodiments above.

Based on the determined bitrate assignment information, the bitstream is decoded in a scalable audio decoding process at 903.

Figure 10A:
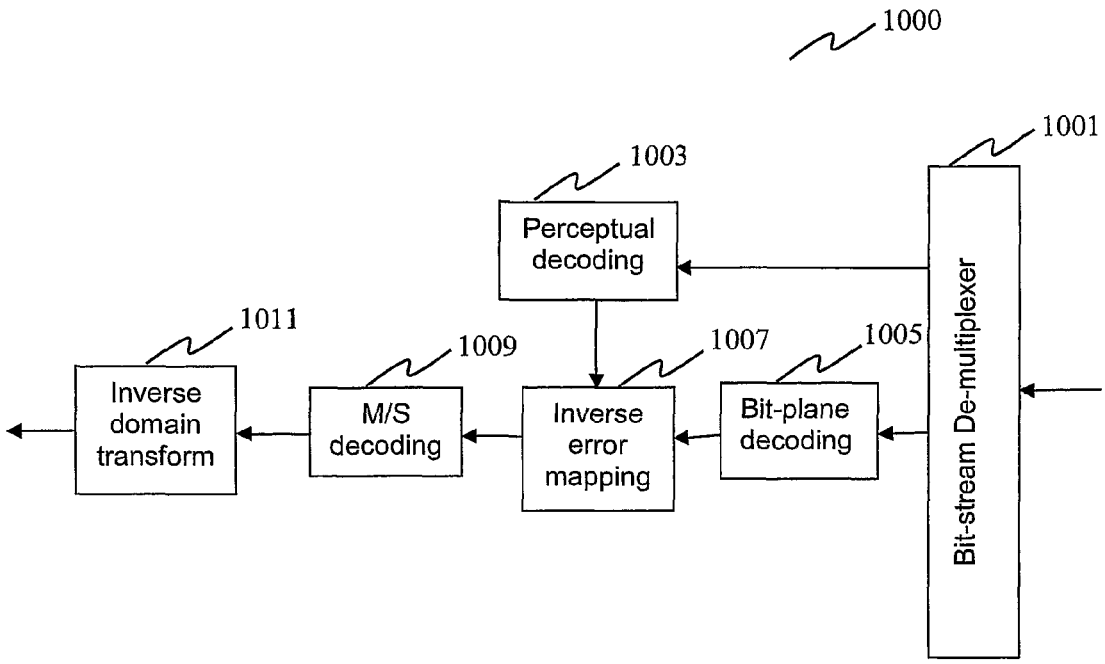
FIGS. 10A and 10B show the structure of a scalable lossless audio decoder according to the embodiments of the invention.
Figure 10B:
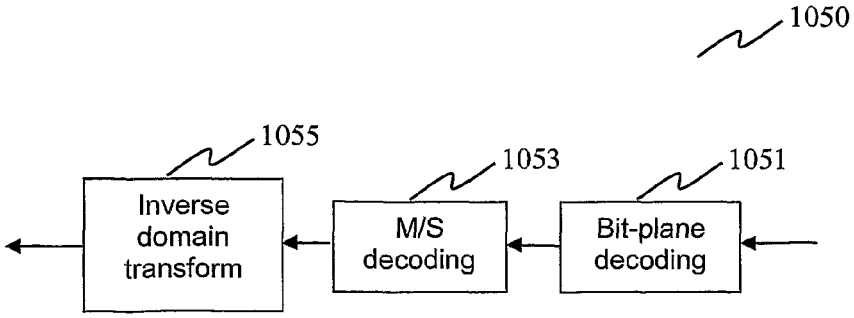

FIGS. 10A and 10B show the structure of a scalable lossless audio decoder 1000, 1050 according to various embodiments of the invention.

In FIG. 10A, the scalable lossless (SLS) audio decoder 1000 includes a bitstream de-multiplexing circuit 1001 configured to de-multiplex an encoded lossless bitstream into a core-layer bitstream and an enhancement-layer bitstream.

The decoder 1000 further includes a perceptual decoding circuit 1003 for decoding the core-layer bitstream to form a core-layer signal, which may constitute the minimum rate/quality unit of the original audio signal. The perceptual decoding circuit 1003 may be called as the core-layer decoding circuit as well. In one example, the decoding circuit 1003 is an MPEG-4 AAC (advanced audio coding) decoder.

The SLS decoder 1000 includes a bit-plane decoding circuit 1005 configured to bit-plane decode the enhancement-layer bitstream to form a bit-plane decoded enhancement-layer signal. The bit-plane decoding circuit 1005 may be configured to decode the enhancement-layer bitstream based on a bitrate assignment information, which indicates different bitrates assigned to different channels of the enhancement-layer bitstream, for example.

An inverse error mapping circuit 1007 is included to perform an inverse error mapping process based on the core-layer signal and the bit-plane decoded enhancement-layer signal, resulting in an error corrected signal.

The SLS decoder 1000 further includes a mid/side decoding circuit 1009 configured to decode the error corrected signal to form a mid/side decoded signal. For example, if the error corrected signal has mid and side channels, the mid/side decoded signal is decoded to left and right channels.

The mid/side decoded signal is then input to an inverse domain transform circuit 1011 to be inversely transformed to a decoded audio signal. The inverse domain transform circuit 1011 may be an inverse integer modified discrete Cosine transform (inverse IntMDCT), for example. The decoded audio signal may be a lossless reconstruction of the original encoded audio signal.

It is noticed that the above perceptual decoding circuit 1003 of the SLS decoder 1000 is used to decode the core-layer bitstream in accordance with the above embodiment.

FIG. 10B shows an non-core scalable lossless audio decoder 1050 according to another embodiment of the invention.

The SLS decoder 1050 includes a bit-plane decoding circuit 1051 configured to bit-plane decode a lossless bitstream to form a bit-plane decoded signal. The bit-plane decoding circuit 1005 may be configured to decode the lossless bitstream based on a bitrate assignment information, which indicates different bitrates assigned to different channels of the lossless bitstream, for example.

The SLS decoder 1050 further includes a mid/side decoding circuit 1053 configured to decode the bit-plane decoded signal to form a mid/side decoded signal. For example, if the bit-plane decoded signal has mid and side channels, the mid/side decoded signal is decoded to left and right channels.

The mid/side decoded signal is then input to an inverse domain transform circuit 1055 to be inversely transformed to a decoded audio signal. The inverse domain transform circuit 1055 may be an inverse integer modified discrete Cosine transform (inverse IntMDCT), for example. The decoded audio signal may be a lossless reconstruction of the original encoded audio signal.

The non-core SLS decoder 1050 may be used such that perceptual information of the encoded lossless bitstream is not used to determine the different bitrates for different channels in the bit-plane decoding process.

The non-core SLS decoder 1050 may also have a structure of the SLS decoder 1000 of FIG. 10A, wherein the perceptual decoding circuit 1003 is disabled.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A method for assigning bitrates to a plurality of channels in a scalable audio encoding process, the method comprising:

assigning different bitrates to different channels in the scalable audio encoding process, wherein the different bitrates are assigned to different channels based on a ratio of a first average maximum bit-plane value and a second average maximum bit-plane value;

wherein the first average maximum bit-plane value comprises an average value of a plurality of maximum bit-plane values for a first channel of the plurality of channels;

wherein the second average maximum bit-plane value comprises an average value of a plurality of maximum bit-plane values for a second channel of the plurality of channels.

2. A method for assigning bitrates to a plurality of channels in a scalable audio encoding process, the method comprising:

assigning different truncated bitrates to different channels in a scalable audio truncation process, wherein, in case a target total bitrate is smaller than or equal to a sum of the first perceptual core bitrate for the first channel of the plurality of channels and the second perceptual core bitrate for the second channel of the plurality of channels, a first truncated bitrate is assigned to a first channel of the plurality of channels in accordance with the following equation:

$$BS_1^T = BS^T \cdot \frac{BS_1^P}{BS_1^P + BS_2^P}; \text{ and}$$

a second truncated bitrate is assigned to a second channel of the plurality of channels in accordance with the following equation:

$$BS_2^T = BS^T \cdot \frac{BS_2^P}{BS_1^P + BS_2^P};$$

wherein $BS_1^T$ denotes the first truncated bitrate assigned to the first channel of the plurality of channels;

$BS^T$ denotes the target total bitrate;

$BS_1^P$ denotes the first perceptual core bitrate for the first channel of the plurality of channels;

$BS_2^P$ denotes the second perceptual core bitrate for the second channel of the plurality of channels;

$BS_2^T$ denotes the second truncated bitrate assigned to the second channel of the plurality of channels.

3. The method of claim 2, further comprising:

in case the target total bitrate is greater than the sum of the first perceptual core bitrate for the first channel of the plurality of channels and the second perceptual core bitrate for the second channel of the plurality of channels, assigning different truncated bitrates to different channels in the scalable audio truncation process based on the target total bitrate, the first perceptual core bitrate, the second perceptual core bitrate, a first enhancement bitrate for an enhancement layer of the first channel, and a second enhancement bitrate for an enhancement layer of the second channel.

4. The method of claim 3, wherein, in case the target total bitrate is greater than the sum of the first perceptual core bitrate for the first channel of the plurality of channels and the second perceptual core bitrate for the second channel of the plurality of channels, the different truncated bitrates are assigned to different channels in the scalable audio truncation process based on the total bitrate, the first perceptual core bitrate, the second perceptual core bitrate, and a ratio between the first enhancement bitrate for an enhancement layer of the first channel and the second enhancement bitrate for an enhancement layer of the second channel.

5. The method of claim 4, wherein, in case the target total bitrate is greater than the sum of the first perceptual core bitrate for the first channel of the plurality of channels and the second perceptual core bitrate for the second channel of the plurality of channels, a first truncated bitrate is assigned to a first channel of the plurality of channels in accordance with the following equation:

$$BS_1^T = BS_1^P + (BS^T - BS_1^P - BS_2^P) \cdot \frac{BS_1 - BS_1^P}{BS_1 - BS_1^P + BS_2 - BS_2^P};$$

a second truncated bitrate is assigned to a second channel of the plurality of channels in accordance with the following equation:

$$BS_2^T = BS_2^P + (BS^T - BS_1^P - BS_2^P) \cdot \frac{BS_2 - BS_2^P}{BS_1 - BS_1^P + BS_2 - BS_2^P};$$

wherein $BS_1^T$ denotes the first truncated bitrate assigned to the first channel of the plurality of channels;

$BS^T$ denotes the target total bitrate;

$BS_1^P$ denotes the first perceptual core bitrate for the first channel of the plurality of channels;

$BS_2^P$ denotes the second perceptual core bitrate for the second channel of the plurality of channels;

$BS_1$ denotes a first partial bitrate provided for the first channel of the plurality of channels;

$BS_2$ denotes a second partial bitrate provided for the second channel of the plurality of channels;

$BS_2^T$ denotes the second truncated bitrate assigned to the second channel of the plurality of channels.

6. A non-transitory computer readable medium storing machine executable instructions, when executed by a processor, performing a scalable audio truncation method, the method comprising assigning different truncated bitrates to different channels in a scalable audio truncation process;

wherein, in case a target total bitrate is smaller than or equal to a sum of a first perceptual core bitrate for a first channel of the plurality of channels and a second perceptual core bitrate for a second channel of the plurality of channels, a first truncated bitrate is assigned to a first channel of the plurality of channels in accordance with the following equation:

$$BS_1^T = BS^T \cdot \frac{BS_1^P}{BS_1^P + BS_2^P};$$

a second truncated bitrate is assigned to a second channel of the plurality of channels in accordance with the following equation:

$$BS_2^T = BS^T \cdot \frac{BS_2^P}{BS_1^P + BS_2^P};$$

wherein $BS_1^T$ denotes the first truncated bitrate assigned to the first channel of the plurality of channels;

$BS^T$ denotes the target total bitrate;

$BS_1^P$ denotes the first perceptual core bitrate for the first channel of the plurality of channels;

$BS_2^P$ denotes the second perceptual core bitrate for the second channel of the plurality of channels;

$BS_2^T$ denotes the second truncated bitrate assigned to the second channel of the plurality of channels.

7. The computer readable medium of claim 6, wherein the scalable audio truncation method further comprises in case the target total bitrate is greater than the sum of the first perceptual core bitrate for the first channel of the plurality of channels and the second perceptual core bitrate for the second channel of the plurality of channels, assigning different truncated bitrates to different channels in the scalable audio truncation process based on the target total bitrate, the first perceptual core bitrate, the second perceptual core bitrate, a first enhancement bitrate for an enhancement layer of the first channel, and a second enhancement bitrate for an enhancement layer of the second channel.

8. The computer readable medium of claim 7, wherein the scalable audio truncation method further comprises, in case the target total bitrate is greater than the sum of the first perceptual core bitrate for the first channel of the plurality of channels and the second perceptual core bitrate for the second channel of the plurality of channels, assigning the different truncated bitrates to different channels in the scalable audio truncation process based on the total bitrate, the first perceptual core bitrate, the second perceptual core bitrate, and a ratio between the first enhancement bitrate for an enhancement layer of the first channel and the second enhancement bitrate for an enhancement layer of the second channel.

9. The computer readable medium of claim 8, wherein the scalable audio truncation method further comprises, in case the target total bitrate is greater than the sum of the first perceptual core bitrate for the first channel of the plurality of channels and the second perceptual core bitrate for the second channel of the plurality of channels, assigning a first truncated bitrate to a first channel of the plurality of channels in accordance with the following equation:

$$BS_1^T = BS_1^P + (BS^T - BS_1^P - BS_2^P) \cdot \frac{BS_1 - BS_1^P}{BS_1 - BS_1^P + BS_2 - BS_2^P};$$

assigning a second truncated bitrate to a second channel of the plurality of channels in accordance with the following equation:

$$BS_2^T = BS_2^P + (BS^T - BS_1^P - BS_2^P) \cdot \frac{BS_2 - BS_2^P}{BS_1 - BS_1^P + BS_2 - BS_2^P};$$

wherein $BS_1^T$ denotes the first truncated bitrate assigned to the first channel of the plurality of channels;

$BS^T$ denotes the target total bitrate;

$BS_1^P$ denotes the first perceptual core bitrate for the first channel of the plurality of channels;

$BS_2^P$ denotes the second perceptual core bitrate for the second channel of the plurality of channels;

$BS_1$ denotes a first partial bitrate provided for the first channel of the plurality of channels;

$BS_2$ denotes a second partial bitrate provided for the second channel of the plurality of channels;

$BS_2^T$ denotes the second truncated bitrate assigned to the second channel of the plurality of channels.

10. A scalable lossless audio encoder, comprising:

a domain transform circuit configured to transform an audio signal to form a transformed signal;

an encoding circuit configured to encode the transformed signal to form a core-layer bitstream;

a mid/side encoding circuit configured to encode the transformed signal to form a mid/side encoded signal;

an error mapping circuit configured to perform an error mapping based on the mid/side encoded signal and the core-layer bitstream to remove information that has been encoded into the core-layer bitstream, resulting in an error signal;

a bit-plane encoding circuit configured to bit-plane encode the error signal based on different bitrates to form an enhancement-layer bitstream, wherein the bit-plane coding circuit comprises an assignment circuit configured to assign the different bitrates to different channels of a plurality of channels in the bit-plane coding process, based on a ratio of a first average maximum bit-plane value which comprises an average value of a plurality of maximum bit-plane values for a first channel of the plurality of channels, and a second average maximum bit-plane value which comprises an average value of a plurality of maximum bit-plane values for a second channel of the plurality of channels; and a multiplexing circuit configured to multiplex the core-layer bitstream and the enhancement-layer bitstream, thereby generating the scalable encoded bitstream.

11. A truncator for scalable audio truncation, comprising an assignment circuit configured to assign different truncated bitrates to different channels of a plurality of channels in the scalable audio truncation process, wherein, in case a target total bitrate is smaller than or equal to a sum of a first perceptual core bitrate for a first channel of the plurality of channels and a second perceptual core bitrate for a second channel of the plurality of channels, the assignment circuit is configured to assign a first truncated bitrate to a first channel of the plurality of channels in accordance with the following equation:

$$BS_1^T = BS^T \cdot \frac{BS_1^P}{BS_1^P + BS_2^P};$$

and assign a second truncated bitrate to a second channel of the plurality of channels in accordance with the following equation:

$$BS_2^T = BS^T \cdot \frac{BS_2^P}{BS_1^P + BS_2^P};$$

wherein $BS_1^T$ denotes the first truncated bitrate assigned to the first channel of the plurality of channels;

$BS^T$ denotes the target total bitrate;

$BS_1^P$ denotes the first perceptual core bitrate for the first channel of the plurality of channels;

$BS_2^P$ denotes the second perceptual core bitrate for the second channel of the plurality of channels;

$BS_2^T$ denotes the second truncated bitrate assigned to the second channel of the plurality of channels.

12. The truncator of claim 11, wherein in case the target total bitrate is greater than the sum of the first perceptual core bitrate for the first channel of the plurality of channels and the second perceptual core bitrate for the second channel of the plurality of channels, the assignment circuit is configured to assign different truncated bitrates to different channels in the scalable audio truncation process based on the target total bitrate, the first perceptual core bitrate, the second perceptual core bitrate, a first enhancement bitrate for an enhancement layer of the first channel, and a second enhancement bitrate for an enhancement layer of the second channel.

13. The truncator of claim 11, wherein, in case the target total bitrate is greater than the sum of the first perceptual core bitrate for the first channel of the plurality of channels and the second perceptual core bitrate for the second channel of the plurality of channels, the assignment circuit is configured to assign the different truncated bitrates to different channels in the scalable audio truncation process based on the total bitrate, the first perceptual core bitrate, the second perceptual core bitrate, and a ratio between the first enhancement bitrate for an enhancement layer of the first channel and the second enhancement bitrate for an enhancement layer of the second channel.

* * * * *

UNITED STATES PATENT AND TRADEMARK OFFICE

CERTIFICATE OF CORRECTION

PATENT NO. : 8,442,836 B2
APPLICATION NO. : 12/865691
DATED : May 14, 2013
INVENTOR(S) : Te Li

It is certified that error appears in the above-identified patent and that said Letters Patent is hereby corrected as shown below:

In the Specifications:

Column 9, line 57: "$x_i$, i=n-1" should be -- $x_i$, $i = 0, \ldots, n-1$ --.

Column 12, lines 20-21:

"hi one embodiment, a target total bitrate $BS^T$ is smaller than or equal to the sum of the first perceptual core bitrate BSP and..."

should be

-- In one embodiment, a target total bitrate $BS^T$ is smaller than or equal to the sum of the first perceptual core bitrate $BS_1^P$ and... --.

Signed and Sealed this
Twenty-third Day of July, 2013

Teresa Stanek Rea
*Acting Director of the United States Patent and Trademark Office*